US005669707A

United States Patent [19]

Huang

[11] Patent Number: 5,669,707

[45] Date of Patent: Sep. 23, 1997

[54] CHRISTMAS LAMP SOCKET

[76] Inventor: Shun-Feng Huang, No. 13, Lane 84, Nei Hu Road, Hsin-Chu City, Taiwan

[21] Appl. No.: 655,150

[22] Filed: May 28, 1996

[51] Int. Cl.[6] ..... F21V 21/00

[52] U.S. Cl. ..... 362/249; 362/252; 362/396; 362/806

[58] Field of Search ..... 362/806, 123, 362/227, 234, 249, 252, 396

[56] References Cited

U.S. PATENT DOCUMENTS

| | | | |
|---|---|---|---|
| 3,214,579 | 10/1965 | Pacini | 362/227 |
| 4,679,126 | 7/1987 | Van Sickler | 362/806 |
| 4,802,072 | 1/1989 | Kau | 362/806 |
| 5,424,925 | 6/1995 | Jenke et al. | 362/123 |
| 5,499,174 | 3/1996 | Lin | 362/806 |
| 5,531,411 | 7/1996 | Adams | 362/123 |
| 5,542,636 | 8/1996 | Mann et al. | 362/396 |

*Primary Examiner*—Carroll B. Dority
*Attorney, Agent, or Firm*—Morton J. Rosenberg; David I. Klein

[57] ABSTRACT

A Christmas lamp socket is provided. The socket has a flexible hooked projection on an outer circumference thereof and a group of cords passed through a bottom thereof. Each group of cords are passed through several sockets of the kind. One of a first group of cords is passed into flexible hooked projection of sockets linked by other group of cords such that the sockets are combined to have various patterns for decoration.

1 Claim, 3 Drawing Sheets

CHRISTMAS LAMP SOCKET

BACKGROUND OF THE INVENTION

Nowadays many families decorate their houses with Christmas lamps in Christmas holidays. They sometimes knit many Christmas lamps into a reticulated shape of Christmas lamps combination. And they twist the house with iron wires, usually on the wall and the roof. Referring to FIG. 3, iron wires 10 are fitted on the roof and connected to the ground, and reticulated Christmas lamps combination 20 is mounted on the roof. However, one has to climb onto the roof to connect the lamps combination 10 to the iron wires 30. It is somewhat difficult and strenuous to walk on the roof to finish the connection. So it is not considered to be a convenient way to fit Christmas lamps onto the roof.

SUMMARY OF THE INVENTION

The present invention relates to a Christmas lamp socket. A bulb is held with the socket. The socket has a flexible hooked projection on an outer circumference thereof and a group of cords passed through a bottom thereof. Each group of cords are passed through several sockets of the kind. One of a first group of cords is passed into flexible hooked projections of sockets linked by other group of cords such that the sockets are combined to have various patterns for decoration.

Then the Christmas lamps combination, usually in a reticulated form, is mounted onto a house roof wall or ceiling.

BRIEF DESCRIPTION OF THE DRAWINGS

The invention will be better understood by reference to the accompanying drawings, wherein.

DESCRIPTION OF THE PREFERRED EMBODIMENTS

Figure 1:
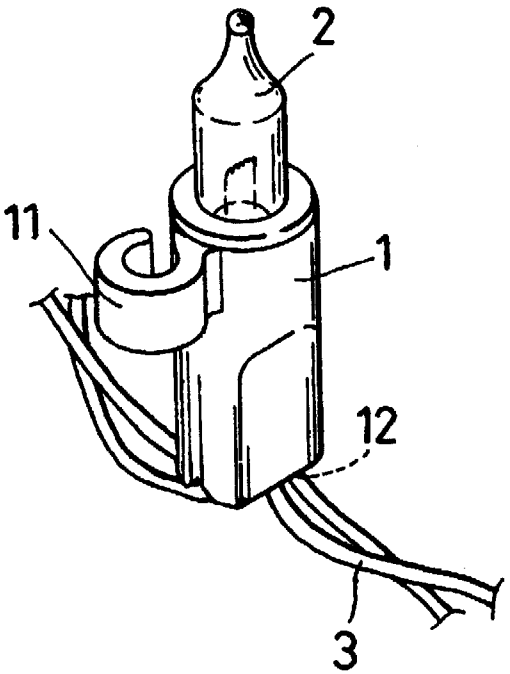
FIG. 1 is a view showing a Christmas lamp socket of the present invention.
Figure 3:
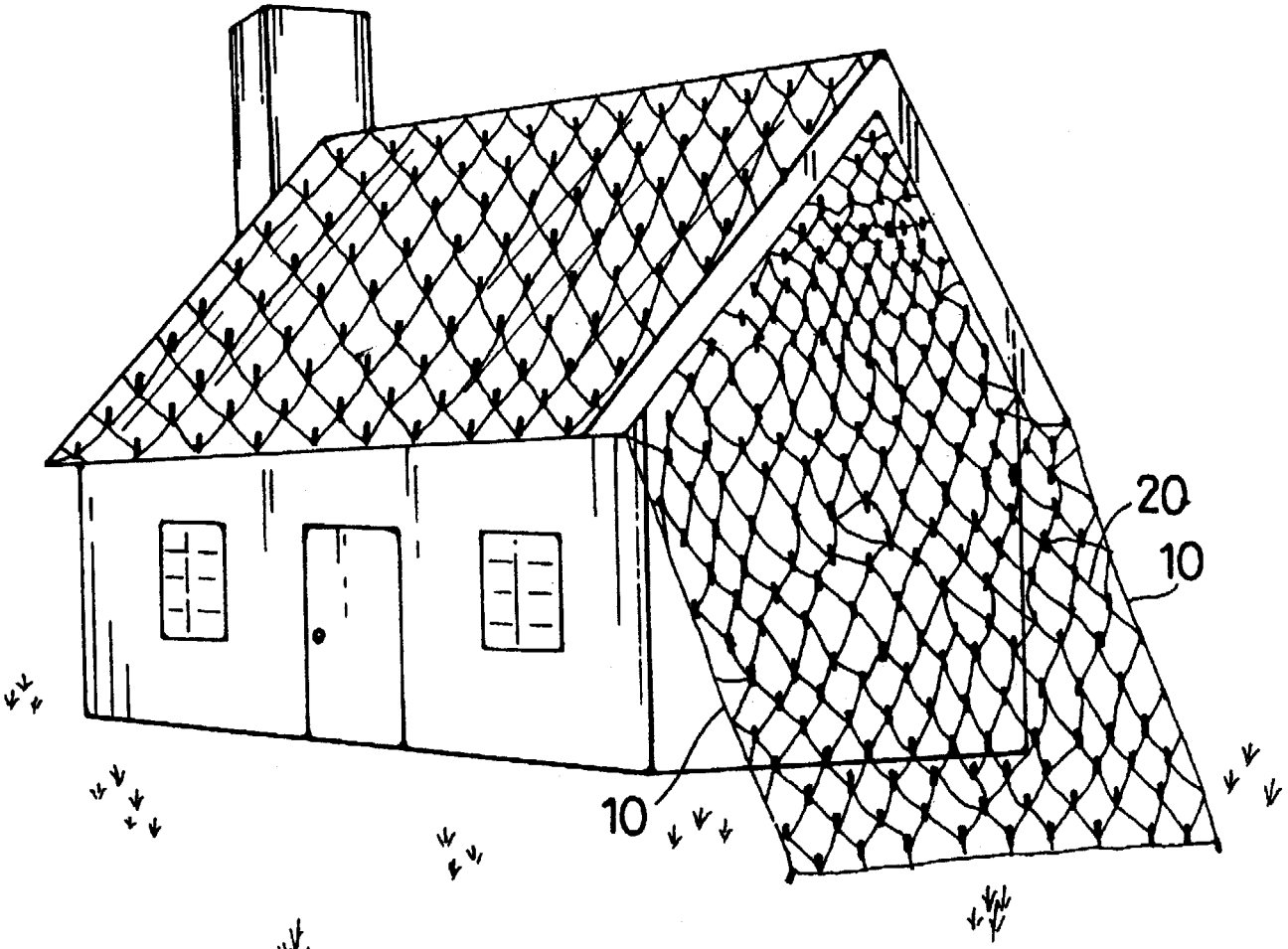
FIG. 3 (PRIOR ART)
FIG. 3 is a view illustrating a prior art Christmas lamps combination mounted on a house roof; and, FIG. 4 is a view illustrating a prior art Christmas lamps combination mounted on a Christmas tree.
Figure 4:
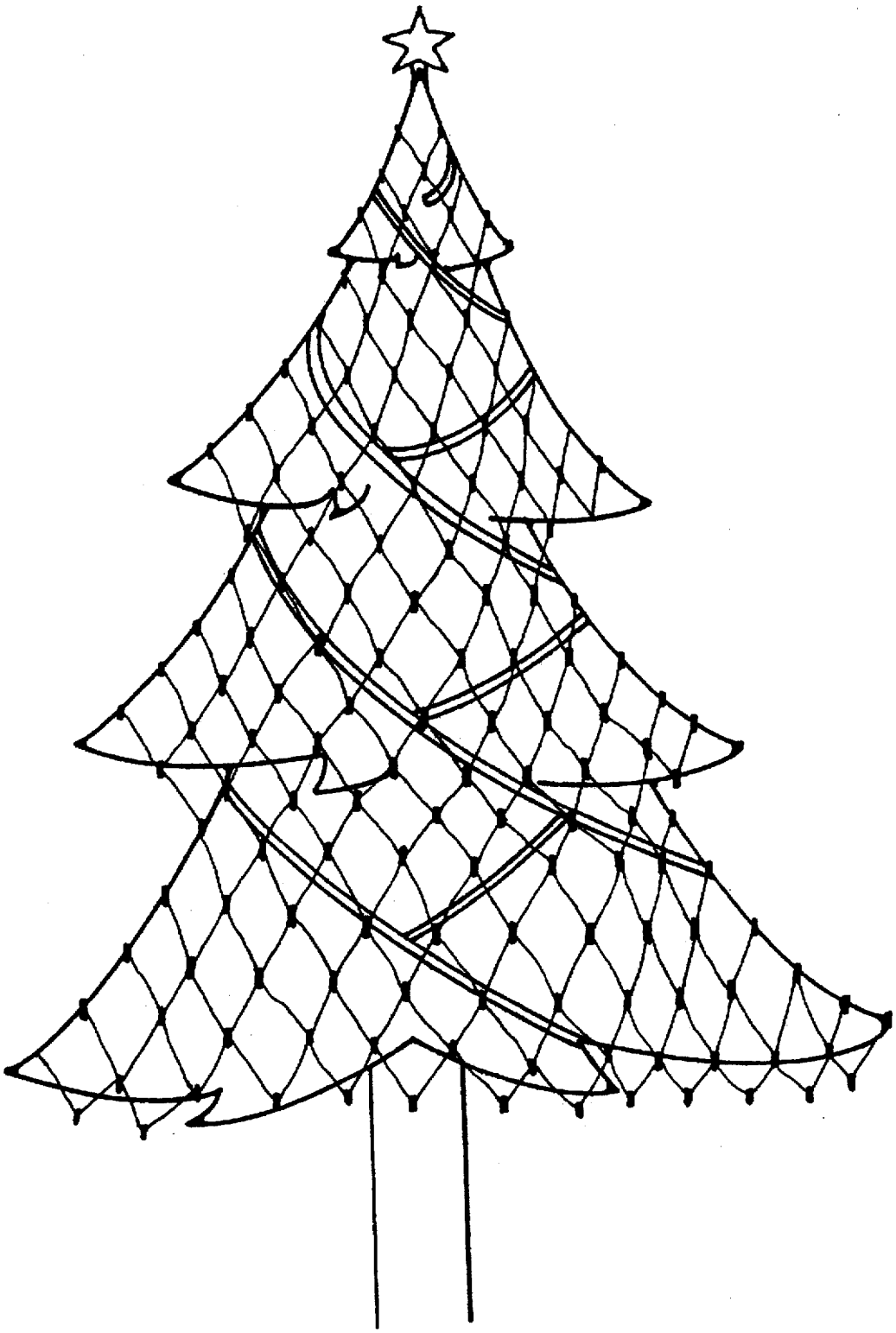
FIG.4 (PRIOR ART)

The present invention relates to a Christmas lamp socket. Referring to FIG. 1, a socket 1 of the present invention has a hooked projection 11 on an outward circumference thereof. A bulb 2 is held in the socket 1. A group of electrical cords 3 are passed through a plurality of sockets 1 of the same kind from bottoms 12 thereof.

The hooked projection 11 is flexible and has a gap and a hole (not numbered). The gap is preferrably made to be close to the socket 1.

Figure 2:
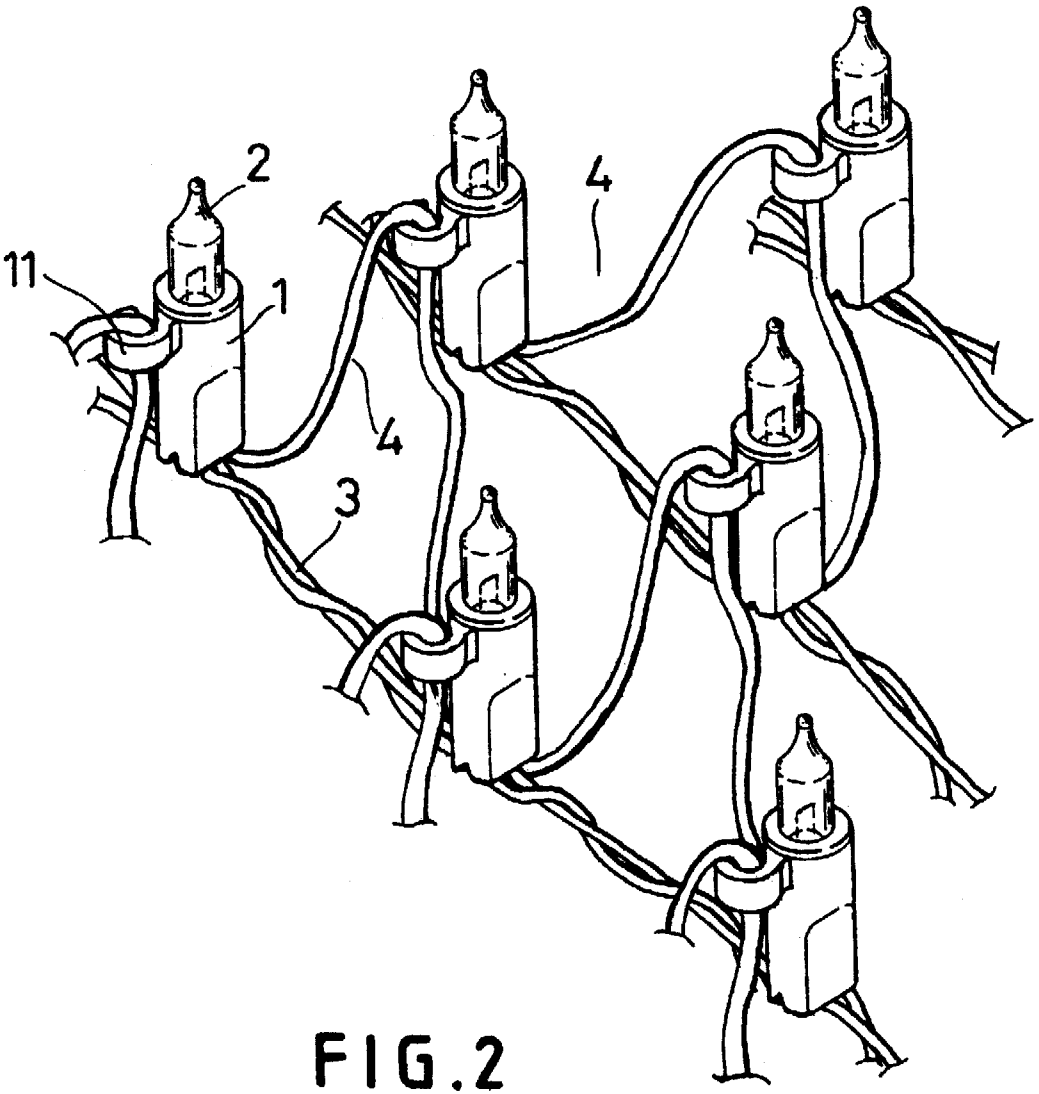
FIG. 2 is a view demonstrating a reticulated combination of the lamp sockets of the present invention.

Referring to FIG. 2, one of a group of cords 4 linking the sockets 1 is passed into flexible hooked projections 11 of sockets 1 linked by other groups of cords 3. Thus, the sockets 1, to which the bulbs 2 are fitted, are made to form a reticulated Christmas lamps combination.

Then the reticulated lamps combination is mounted on a roof of a house from above to be ready for use.

Furthermore, manufacturers may previously knit the sockets into various patterns with ornamental effect such that customers can choose what is preferred to decorate their houses.

The reticulated Christmas lamp sockets of the present invention do not need to be further connected with iron wires on the roof. So the fitting method is very easy in comparision with that of the prior art Christmas lamps.

While the preferred embodiments of the invention have been described above, it will be recognezed and understood that various modifications may be made therein and the appended claims are intended to cover all such modifications which may fall within the spirit and scope of the invention.

What is claimed is:

1. A lamp socket structure comprising:

a first set of lamp sockets electrically connected each to the other by a first set of electrical cords; and a second set of lamp sockets electrically connected each to the other by a second set of electrical cords, said second set of lamp sockets being coupled to said first set of lamp sockets, each of said lamp sockets of said first and second sets having a hooked projection member extending from a side wall thereof, an electrical cord of said first set of electrical cords extending from a socket in said first set through a hooked projection is a socket of said second set and back to the next succeeding socket in said first set.

* * * * *